US006305597B1

(12) United States Patent
Donegan et al.

(10) Patent No.: US 6,305,597 B1
(45) Date of Patent: Oct. 23, 2001

(54) ONE-PIECE FOLDING CARTON WITH INTEGRALLY FORMED SLIDING DISPLAY HANG TAB

(75) Inventors: Barbara Vollmer Donegan, Morris Township, NJ (US); Richard Mazurek, Huntingdon Valley, PA (US)

(73) Assignee: IMPAC Group, Inc., New York, NY (US)

( * ) Notice: Subject to any disclaimer, the term of this patent is extended or adjusted under 35 U.S.C. 154(b) by 0 days.

(21) Appl. No.: 09/620,448

(22) Filed: Jul. 20, 2000

(51) Int. Cl.[7] ..... B65D 5/462

(52) U.S. Cl. ..... 229/117.22; 206/806; 229/117.24; 493/162; 493/909

(58) Field of Search ..... 229/117.18, 117.22, 229/117.24; 206/163, 806; 493/162, 183, 909

(56) References Cited

U.S. PATENT DOCUMENTS

| | | | | |
|---|---|---|---|---|
| 3,074,614 | | 1/1963 | Moffat . | |
| 3,587,837 | | 6/1971 | Smith et al. | 206/45.14 |
| 3,820,710 | * | 6/1974 | Burgess et al. | 229/117.2 |
| 4,020,947 | | 5/1977 | Roccaforte | 206/45.31 |
| 4,106,615 | * | 8/1978 | Hiroshi | 229/117.18 |
| 4,230,259 | * | 10/1980 | Herzog | 206/806 |
| 4,279,376 | | 7/1981 | Roccaforte . | |
| 4,291,807 | * | 9/1981 | Giordano et al. | 206/806 |
| 4,457,431 | | 7/1984 | Lundquist et al. | 206/491 |
| 5,020,718 | * | 6/1991 | Zimmermann | 229/117.22 |
| 5,458,233 | | 10/1995 | Herrin | 206/45.31 |
| 5,566,831 | * | 10/1996 | Swenson | 206/806 |
| 6,145,659 | * | 11/2000 | Fairdoth et al. | 206/806 |

* cited by examiner

*Primary Examiner*—Gary E. Elkins
(74) *Attorney, Agent, or Firm*—Priest & Goldstein, PLLC

(57) ABSTRACT

A folding carton is described that includes a hang tab that is slidable between a first position in which the hang tab is tucked behind a first carton panel, and a second position in which the hang tab extends out of the carton for hanging the carton on a display. The carton further includes a hang tab restraint for preventing the hang tab from being pulled entirely out of the carton. The hang tab is initially held in its first position by breakaway nicks that attach the hang tab to the carton. According to further aspects of the invention, the hang tab restraint comprises a yoke flap folded over the hang tab or, alternatively, a tongue member that fits into a central slot of the hang tab.

32 Claims, 11 Drawing Sheets

ONE-PIECE FOLDING CARTON WITH INTEGRALLY FORMED SLIDING DISPLAY HANG TAB

BACKGROUND OF THE INVENTION

1. Field of the Invention

The present invention relates generally to improvements in folding cartons, and particularly to advantageous aspects of a folding carton having a built-in, sliding hang tab.

2. Description of the Prior Art

Certain retail goods, such as cosmetics, are packaged in small cartons that are typically fabricated from a sheet of cardboard or plastic that has been cut into a predetermined shape, folded, and then glued. There are two basic modes for displaying these goods in a retail store. In a first "counter display" mode, the cartons are stacked on a flat surface, such as a counter or a shelf. In a second "hang display" mode, the cartons are hung on posts extending horizontally outward from a pegboard or other vertical surface. In a hang display, the upper portion of each carton is typically provided with a tab or flap having a hole or slot that slides over the post.

The choice of display mode is governed by two major considerations: the attractiveness of the display, and the efficient use of retail space. A counter display is typically more attractive than a hang display and is therefore chosen for higher-end products. Further, a hang tab or flap on a carton can be unsightly and interfere with the esthetic design of the carton. However, a counter display typically does not use retail space as efficiently as a hang display, in which several different items can be spaced closely together in both a vertical and a horizontal direction.

It may be desired for a number of reasons to use a counter display for a particular product in one retail setting, but to use a hang display for the same product in a different retail setting. It is desirable for reasons of economy and efficiently to use the same carton for both a counter display and a hang display. However, because of esthetic considerations, it is desirable for the hang tab to be hidden from view in a counter display and yet easily accessible for use in a hang display. Further, it desirable for such a hang tab to be manufactured as economically as possible.

SUMMARY OF THE INVENTION

In one aspect, the invention provides a folding carton having a hang tab that is slidable between a first, retracted position in which the hang tab is tucked behind a first carton panel, and a second, extended position in which the hang tab extends out of the carton for hanging the carton on a display. The carton further includes a hang tab restraint for preventing the hang tab from being pulled entirely out of the carton. The hang tab is initially held in its first position by breakaway nicks that attach the hang tab to the carton. According to further aspects of the invention, the hang tab restraint comprises a yoke flap folded over the hang tab or, alternatively, a tongue member that fits into a central slot of the hang tab.

Additional features and advantages of the present invention will become apparent by reference to the following detailed description and accompanying drawings.

BRIEF DESCRIPTION OF THE DRAWINGS

In FIG. 1A, the carton's hang tab is in its initial, retracted position. In FIG. 1B, the hang tab is in its second, extended position.

In FIG. 7A, the hang tab is in its initial, retracted position, and in FIG. 7B, the hang tab is in its second, extended position.

DETAILED DESCRIPTION

Figure 1A:
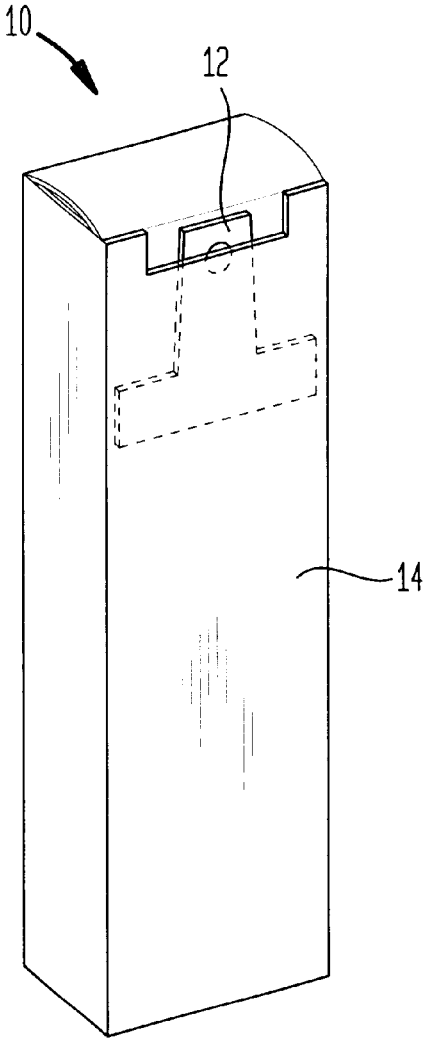
FIGS. 1A and 1B show rear perspective views of a carton according to a first embodiment of the present invention.
Figure 1B:
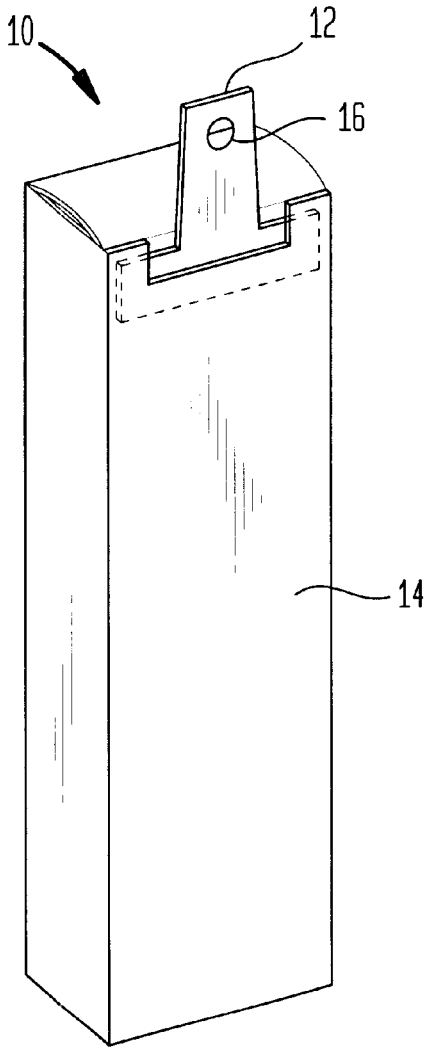

FIGS. 1A and 1B show rear perspective views of a first embodiment of a folding carton 10 according to the present invention. The carton 10 includes a hang tab 12 that, in FIG. 1A, is tucked behind the rear panel 14 of the carton 10. In FIG. 1B, the hang tab 12 has been pulled out into an extended position, exposing an eye 16 that is dimensioned to fit over a post in a hang display. The hang tab 12 freely slides between its tucked and extended positions.

As described below, in the first embodiment of the invention, illustrated in FIGS. 1A–B, 2, and 3A–E, and in the alternative embodiments of the invention illustrated in FIGS. 4, 5, and 6A–C and discussed below, the carton includes a yoke arrangement that acts as a restraint, preventing the hang tab from being pulled all the way out of the carton. In the alternative embodiments of the invention illustrated in FIGS. 7A–C, 8, 9A–D, 10, and 11, discussed further below, the hang tab is prevented from being pulled all the way out of the carton by a tongue member extending from an interior surface of the carton that engages a slot in the hang tab.

Figure 2:
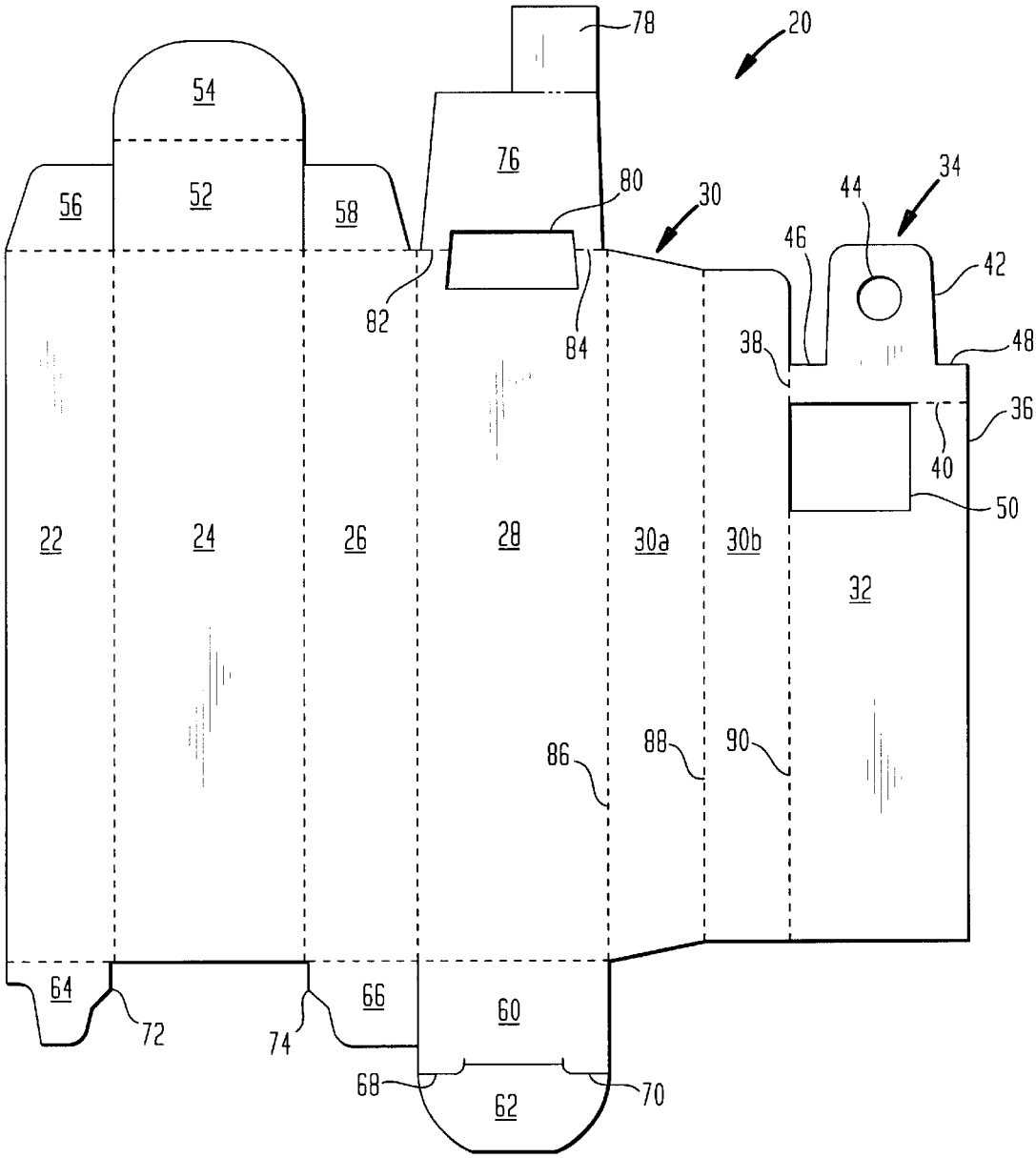
FIG. 2 shows an interior plan view of a carton blank that can be used to fabricate the carton shown in FIGS. 1A and 1B.

In the first embodiment of the invention, the carton 10 shown in FIGS. 1A and 1B is fabricated from a sheet of cardboard that is cut and scored to form a blank that is then folded and glued, as described below. Other suitable materials that can be used to fabricate the carton include paperboard, corrugated or fluted board, plastic, etc. Also, it is possible to incorporate the present invention into a carton fabricated from more than one sheet of material, such as the windowed carton shown in FIG. 5 and discussed below, in which a sheet of mylar or other clear plastic is glued over an opening in a carton panel. FIG. 2 shows an interior plan view of a blank 20 according to the present invention. When the blank 20 is fabricated from cardboard, the blank typically includes a glossy, coated side forming the exterior surfaces of the finished carton and a matte, uncoated side forming the interior surfaces of the finished carton. The exterior surface of the blank typically includes a graphic design, as well as printed text identifying the product and its ingredients. Although it would be theoretically possible to use cardboard having two glossy, coated sides, this adds to the cost of the carton. In FIG. 2, the blank 20 is shown from its uncoated, interior side.

As shown in FIG. 2, the blank 20 includes the following components: a right side panel 22, a front panel 24, a left side panel 26, a rear panel 28, a glue flap panel 30 having two sections 30*a* and 30*b*, and a hang tab support panel 32. A hang tab 34 is affixed to the right section of the glue flap panel 30*b* by a breakaway nick 38. The hang tab 34 is also affixed to a support arm 36 extending upward from the hang tab support panel 32 by breakaway nicks 40. The hang tab 34 includes a head section 42 having an eye 44 punched therein, the eye 44 being dimensioned to fit over a display rod. The size and shape of the eye 44 may be modified, as needed. The hang tab 34 further includes a pair of shoulders 46 and 48. In addition, the hang tab 34, hang tab support arm 36, hang tab support panel 32 and glue flap panel 30*b* together define a square opening 50, the function of which is described further below.

The blank 20 further includes a top panel 52 with an integrally formed tuck 54 and a pair of dust flaps 56, 58 for closing the top of the finished carton and a bottom panel 60 with its own integrally formed tuck 62 and dust flaps 64, 66 for closing the bottom of the finished carton. This particular configuration of tucks 54 and 62 relative to the carton panels 22–28 is known as a French tuck. However, alternative configurations may also be used in conjunction with the present invention. In addition, the bottom panel 60 and tuck 62 include a pair of slit locks 68, 70 that fit over corresponding locking projections 72, 74 on the bottom dust flaps 64, 66 for holding the bottom panel 60 and tuck 62 in place after they have folded to close the bottom of the finished carton.

Extending from the top of the rear panel 28 is a yoke flap 76 and yoke flap glue tab 78. Between the base of the yoke flap 76 and the rear panel 28 is a yoke opening 80. The yoke opening 80 is dimensioned such that the head section 42 of the hang tab 34 passes freely through the yoke opening 80. However, the sides of the yoke opening 80 engage the shoulders 46 and 48 of the hang tab 34 to prevent the hang tab 34 from being pulled all the way through the yoke opening 80. As shown in FIG. 2, score lines 82 and 84 are provided at either side of the yoke opening 80 to facilitate the folding of the yoke flap 76 down over the rear carton panel 28.

In the first embodiment of the invention, the score line 86 between the rear panel 28 and the glue flap panel 30, and all of the score lines to the left of that score line, are pressed into the blank 20 without penetrating the surface of the cardboard. The score line 88 between the two sections 30*a* and 30*b* of the glue flap panel 30 is cut part way through the cardboard because of the length of the score line 88 and because the two sections 30*a* and 30*b* of the glue flap panel 30 must be folded 180 degrees so that the two section 30*a* and 30*b* abut each other. The score line 90 between the glue flap panel 30 and the hang tab support panel 32 is perforated. This perforation is desirable because the blank 20 is first folded along score line 88, and then folded along score lines 86 and 90 simultaneously. The use of a perforated score 90 allows both the exterior fold along score line 86 and the interior fold along score line 88 to be made cleanly.

Figures 3A, 3B, 3C, 3D, 3E:
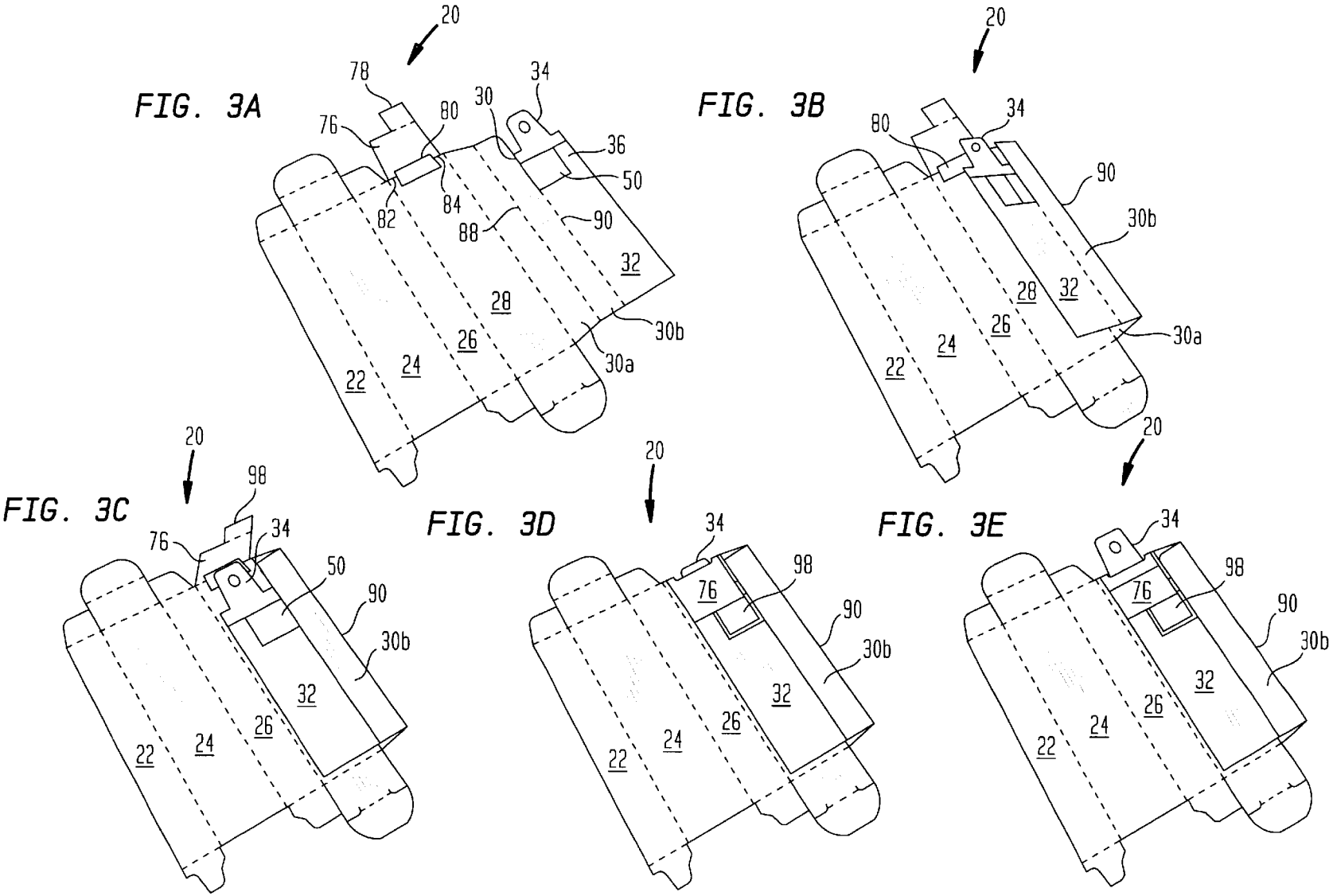
FIGS. 3A through 3E show sequential perspective views of the carton blank shown in FIG. 2, illustrating the construction and operation of the sliding hang tab.

FIGS. 3A through 3E are sequential perspective views illustrating the construction and functioning of a sliding tab using the blank 20 shown in FIG. 2. As shown in FIG. 3B, a first fold is made along score line 90. After this fold is made, the two sections 30*a* and 30*b* of the glue flap panel 30 abut each other, and the hang tab support panel 32 abuts the rear panel 28. In addition, the hang tab 34 is now positioned directly underneath the yoke opening 80.

As illustrated in FIG. 3C, the yoke flap is then folded down over the hang tab 34 along score lines 82 and 84. Score lines are provided through yoke side sections 82 and 84 to facilitate this fold. After the fold is made, the yoke flap glue tab 78 lies directly over the opening 50 underneath the hang tab 34. As illustrated in FIG. 3D, the yoke flap glue tab 78 is glued to the rear panel 28 through the opening 50. The gluing of the yoke flap glue tab 78 to the rear panel 28 traps the hang tab 34 underneath the yoke flap glue tab 78. The uppermost portion of the hang tab 34 peeks through the yoke opening.

In the finished carton, the hang tab 34 is held in its tucked position by a first set of breakaway nicks 38 that connect it to the glue flap panel 30 and a second set of breakaway nicks 40 that connect it to the hang tab support arm 36. However, these nicks 38 and 40 are easily broken by pulling upward on the exposed uppermost portion of the hang tab 34. As illustrated in FIG. 3E, the hang tab 34 is prevented from being pulled all of the way out of the carton by the yoke flap 76 that engages the hang tab shoulders 46 and 48.

The carton is further assembled by folding the front panel 24, rear panel 28, and side panels 22 and 26 so that they form a rectangular tube and by gluing the glue flap panel 30 to the inside of the right side panel 22. The bottom dust flaps and tuck are then folded to close the bottom of the carton. The carton is filled, and then the top dust flaps and tuck are folded to close the top of the carton. These operations are typically performed by machine, but can also of course be performed by hand.

It will be appreciated that once the carton has been constructed, filled and closed, the lateral motion of the hang tab 34 underneath the yoke flap 76 is limited on one side by the left side panel 26 and on the other side by the glue flap panel 30 that has been glued to the right side panel 22, which are now perpendicular to the rear panel 28. If desired, the carton blank 20 may initially only be partially folded and assembled for shipping purposes and then completed at a later point in time.

Thus, the carton 10 illustrated in FIGS. 1A and 1B is suitable for use in both a counter display mode, shown in FIG. 1A, and a hang display mode, shown in FIG. 1B. In the counter display mode, the hang tab 18 is in a first, retracted position, in which the hang tab 18 is tucked behind a first carton panel 14. In the hang display mode, the hang tab 18 protrudes out of the carton 10 in a second, extended position, in which the hang tab 18 extends out from behind the first carton panel 14 for hanging the carton on a display. Further, the carton 10 may be converted back and forth between its counter display and hang display modes as many times as needed. This provides a retailer with maximum flexibility, without requiring different cartons for each display mode.

Figure 4:
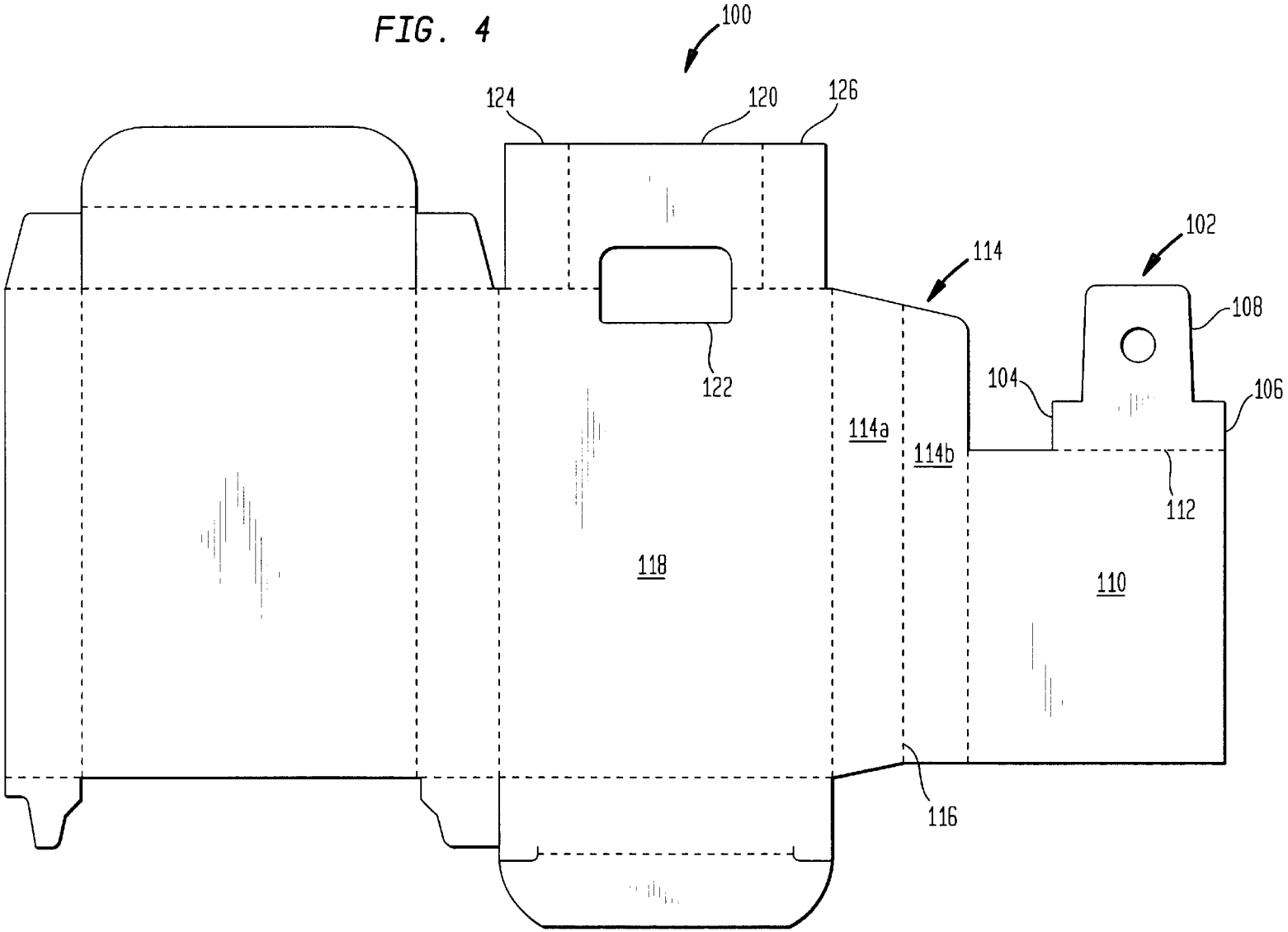
FIG. 4 shows an interior plan view of a carton blank according to a second embodiment of the present invention.

FIG. 4 shows a plan view of the interior side of a carton blank 100 according to a second embodiment of the present invention. As shown in FIG. 4, the blank includes a hang tab 102 having a pair of shoulders 104 and 106 and a narrower head section 108. The hang tab 102 is mounted to a hang tab support panel 110 by a set of breakaway nicks 112. The hang tab support panel 110 extends from the right side of a glue flap panel 114 having two sections 114*a* and 114*b* that are folded along a score line 116, such that they abut each other in the finished carton.

The glue flap panel 114 extends from the right side of a rear carton panel 118. Extending upward from the rear carton panel 118 is a yoke flap 120. Between the yoke flap 120 at the rear carton panel 118 is a yoke opening 122 that is dimensioned so that the hang tab head section 108 passes freely through the yoke opening 122. However, the hang tab 102 is prevented from being fully pulled through the yoke opening 122 by the engagement of the hang tab shoulders 104 and 106 by the sides of the yoke opening 122.

The hang tab 102 and the yoke flap 120 are positioned with respect to each other such that when the glue flap panel 114 is folded along its central score 116, the hang tab 102 is aligned directly under the yoke flap 120. When the yoke flap 120 is then folded over the hang tab 102, an upper portion of the hang tab 102 protrudes through the yoke opening 122, thereby providing user access to the hang tab 102. Further the yoke flap 120 includes at either side a pair of rectangular glue sections 124 and 126, which are glued to the rear panel 118 on either side of the hang tab 102. This traps the hang tab 102 beneath the yoke flap 120, preventing lateral movement of the hang tab 102.

When the carton has been fully assembled, if the user wishes to use the carton in a hang display, the user grasps the upper portion of the hang tab 102 protruding through the yoke opening 122 and pulls upward. This breaks the nicks 112 holding the hang tab 102 to the hang tab support panel 110, along the hang tab 102 to be pulled upward until the sides of the yoke opening 122 engage the hang tab shoulders 104 and 106.

Figure 5:
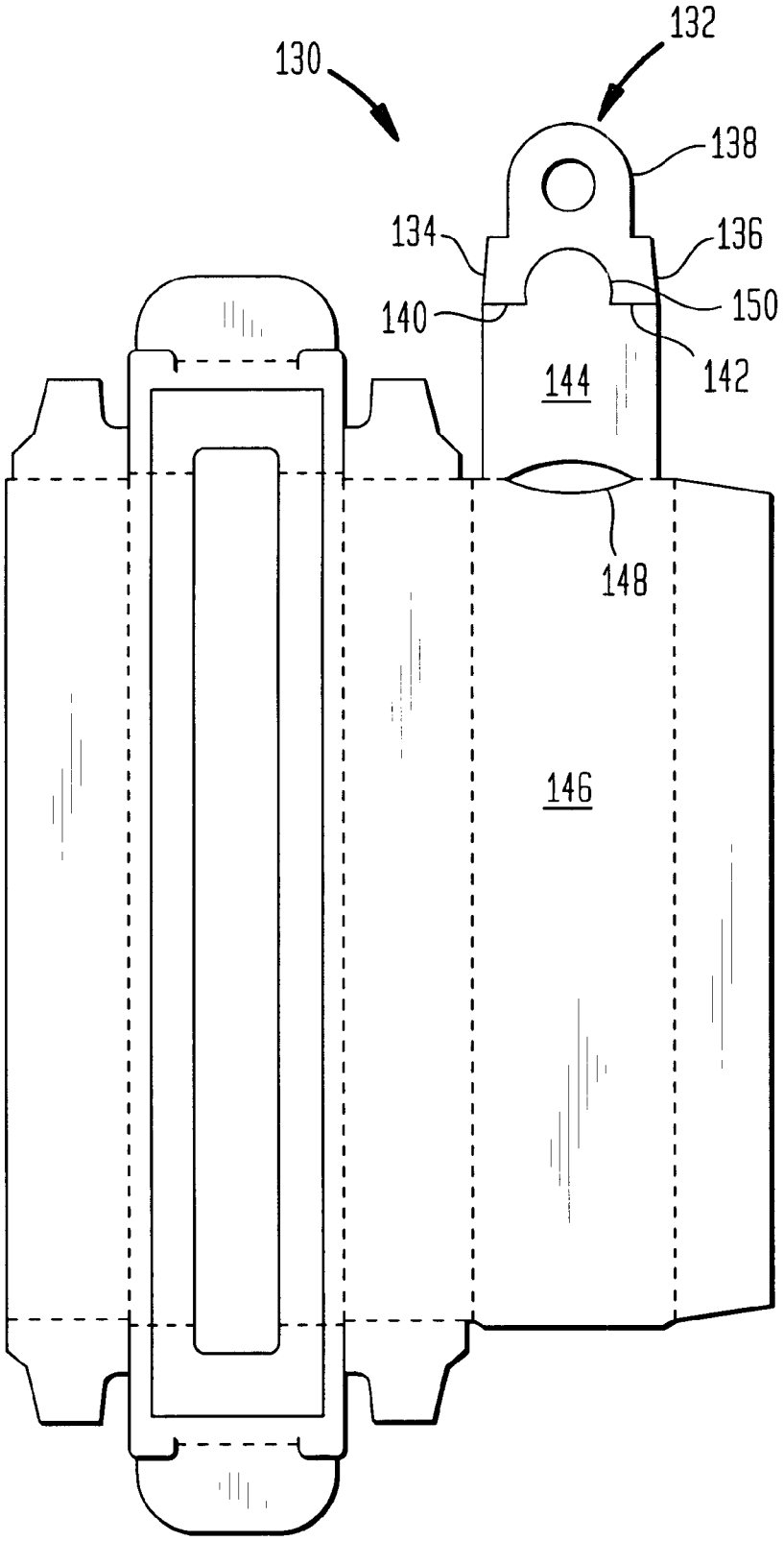
FIG. 5 shows an interior plan view of a carton blank according to a third embodiment of the present invention.

FIG. 5 shows a plan view of the interior side of a carton blank 130 according to a third embodiment of the present invention. In this embodiment of the invention, the hang tab 132 again is provided with a pair of shoulders 134 and 136 and a narrow head section 138. However, in the FIG. 5 embodiment of the invention, the hang tab 132 is attached by a pair of nicked sections 140 and 142 to the top of a yoke flap 144, which in turn extends from the top of a rear carton panel 146. A yoke opening 148 is provided between the yoke flap 144 and the rear carton panel 146. The yoke opening 148 is dimensioned to allow the hang tab head section 138 to pass freely through the opening 148. However, the hang tab 132 is prevented from being pulled all the way through the opening 148 by the engagement of the hang tab shoulders 134, 136 by the sides of the yoke opening 148. The top of the yoke flap 144 includes a semicircular glue tab 150 that is used to glue the yoke flap 144 to the rear carton panel 146 around the hang tab 132.

Figure 6A:
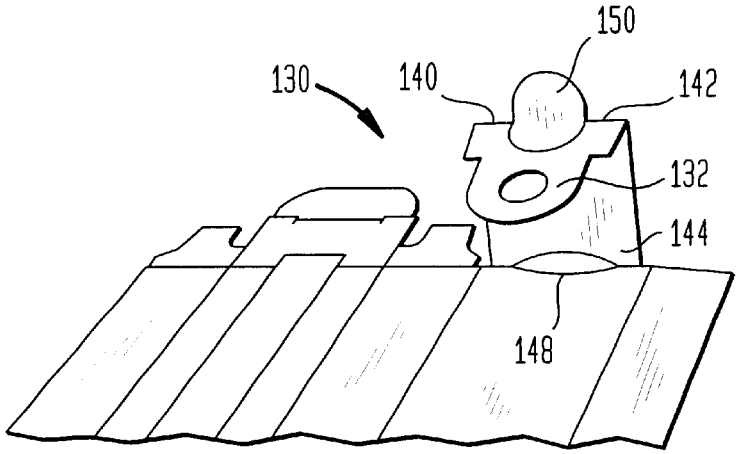
FIGS. 6A through 6C show sequential rear perspective views of the carton blank shown in FIG. 5, illustrating the construction and operation of the sliding hang tab.
Figure 6B:
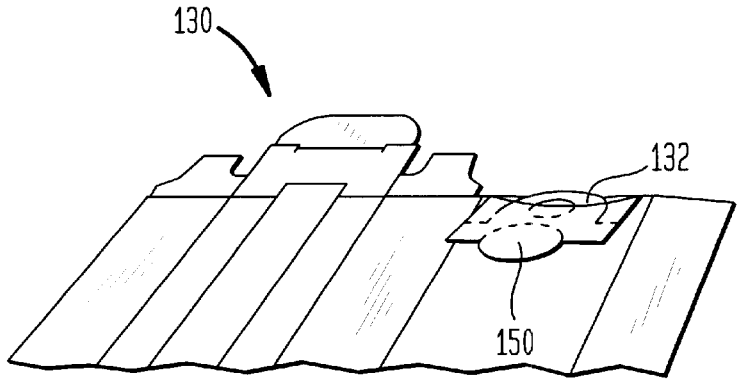
Figure 6C:
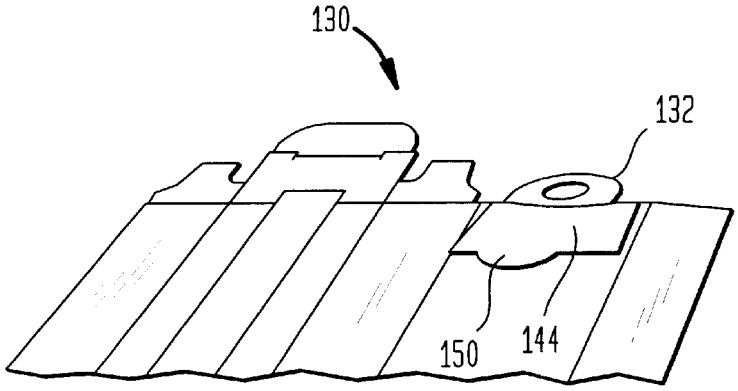

The construction of the yoking arrangement of the FIG. 5 carton blank 130 is illustrated in FIGS. 6A through 6C. As shown in FIG. 6A, the hang tab 132 is folded downward along its nicked sections 140 and 142, which function as score lines, until the hang tab 132 abuts the yoke flap 144. This folding exposes the yoke flap glue tab 150. As shown in FIG. 6B, the folded hang tab 132 and yoke flap 144 are then folded down over the rear carton panel 146, and the yoke flap glue tab 150 is glued to the rear carton panel 146. For purposes of illustration, in FIG. 6B, the yoke flap 144 is transparent, showing the position of the hang tab 132. Typically, yoke flap 144 will be opaque. The dimensions and position of the hang tab 132 and the yoke opening 148 are chosen such that after this operation is performed, an upper portion of the hang tab 132 protrudes through the yoke opening 148 for user access.

If a user wishes to use the finished carton in a hang display, the user grasps the upper portion of the hang tab 132 protruding through the yoke opening 148 and pulls upward. This causes the hang tab 132 to break away from the yoke flap 144 along the nicked sections 140 and 142. As illustrated in FIG. 6C, the hang tab 132 can then be pulled upward until the hang tab shoulders 134 and 136 engage the sides of the yoke opening 148. It will be seen that the gluing of the glue tab 150 to the rear carton panel 146 traps the hang tab 132 between the yoke flap 144 and the rear carton panel 146.

Figure 7C:
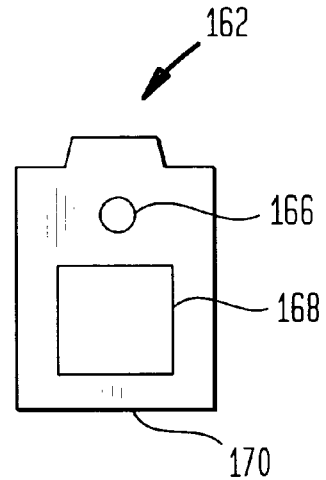
FIG. 7C shows a plan view of the sliding hang tab used in the carton shown in FIGS. 7A and 7B.
Figure 7B:
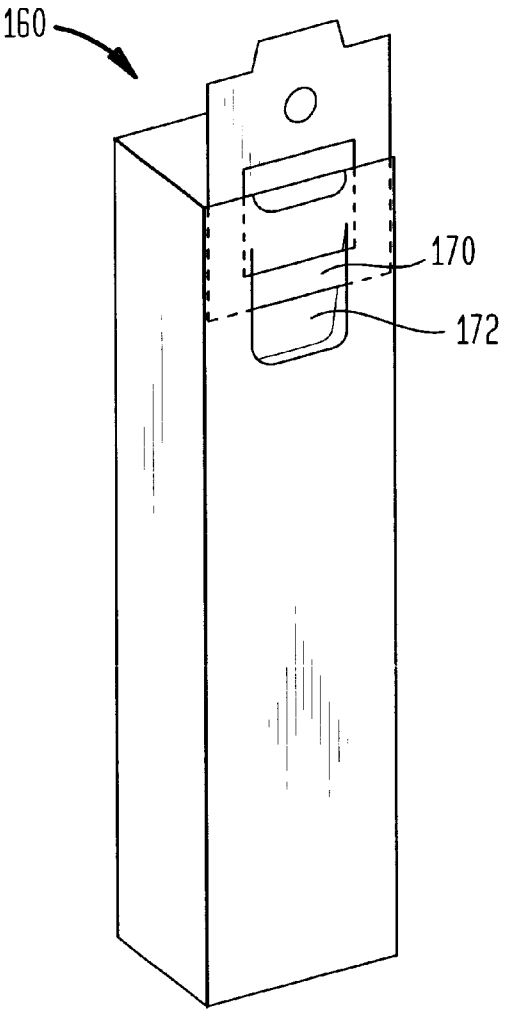
FIGS. 7A and 7B show rear perspective views of a carton according to a fourth embodiment of the present invention.
Figure 7A:
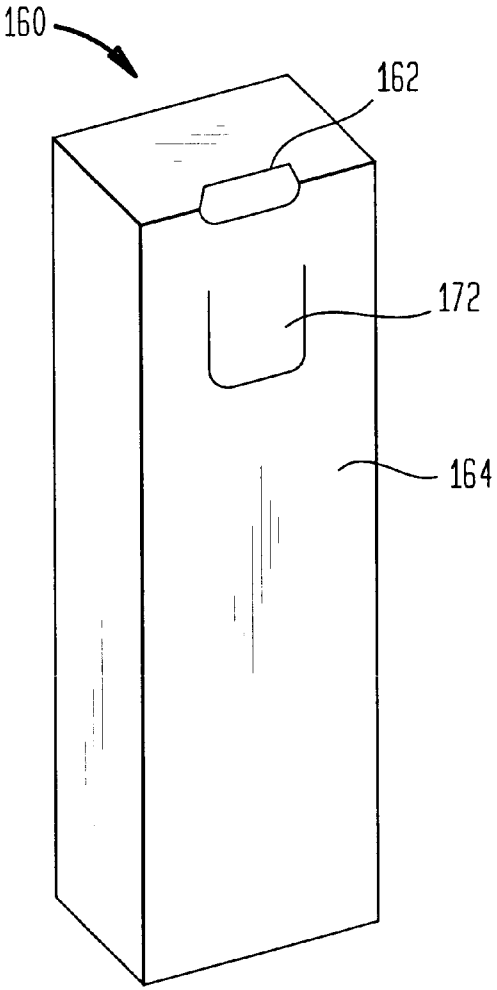

FIG. 7A shows a further embodiment of a folding carton 160 according to the present invention. The carton 160 includes a hang tab 162 that, in FIG. 7A, is tucked behind the rear panel 164 of the carton 160. FIG. 7D shows the hang tab 162 pulled out to its fully extended position, exposing an eye 166 in the hang tab 162 that is dimensioned to fit over a post in a hang display. FIG. 7C is a front view of the hang tab 162, removed from the carton 160. In addition to the eye 166, the hang tab 162 further includes a central slot 168 and a bottom crossbar 170.

As shown in FIGS. 7A and 7B, the rear panel 164 of the carton 160 further includes a tongue member 172 that pushes into the interior of the carton 160. The tongue member 172 is dimensioned to closely fit within the central slot 168 of the hang tab 162. Thus, as illustrated in FIG. 4B, when the tongue member is inserted into the hang tab slot 168, the upward movement of the hang tab 168 is restrained by the hang tab crossbar 170 engaging the base of the tongue member 166.

Figure 8:
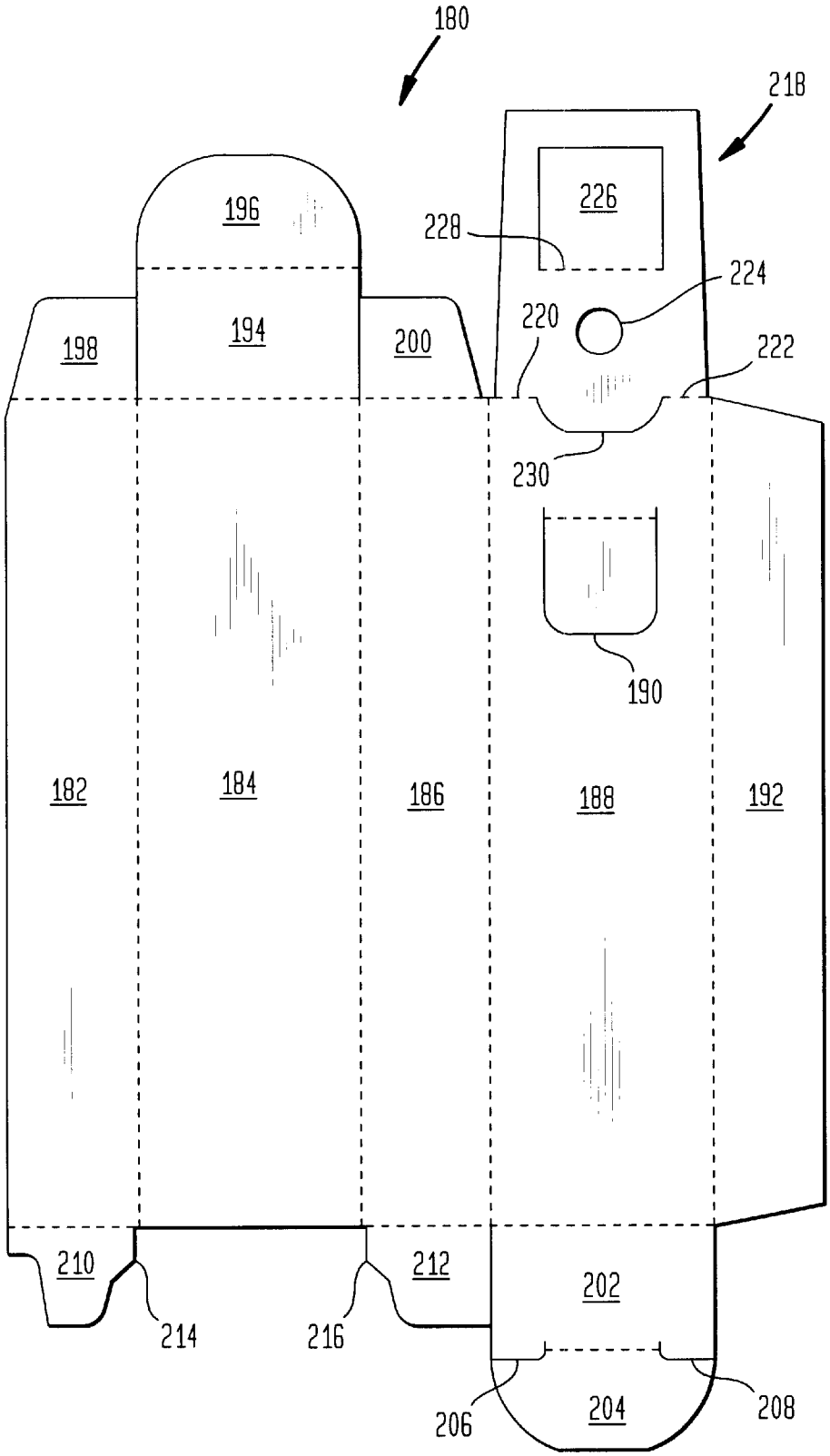
FIG. 8 is an interior plan view of a carton blank that can be used to fabricate the carton and hang tab shown in FIGS. 7A through 7C.
Figure 9A:
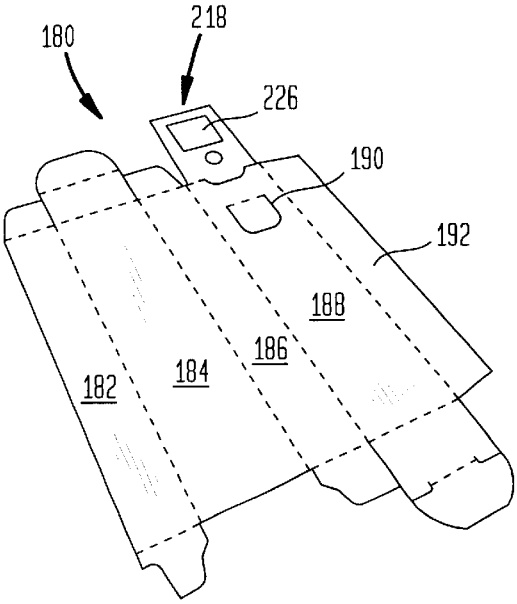
FIGS. 9A through 9D show sequential rear perspective views of the carton blank shown in FIG. 8, illustrating the construction and operation of the sliding hang tab.
Figure 9B:
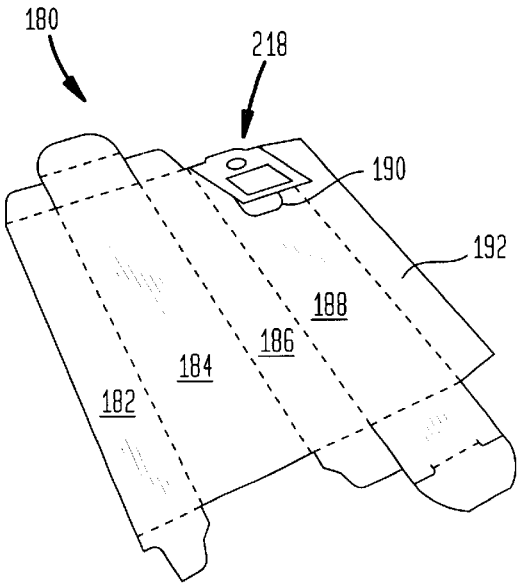
Figure 9C:
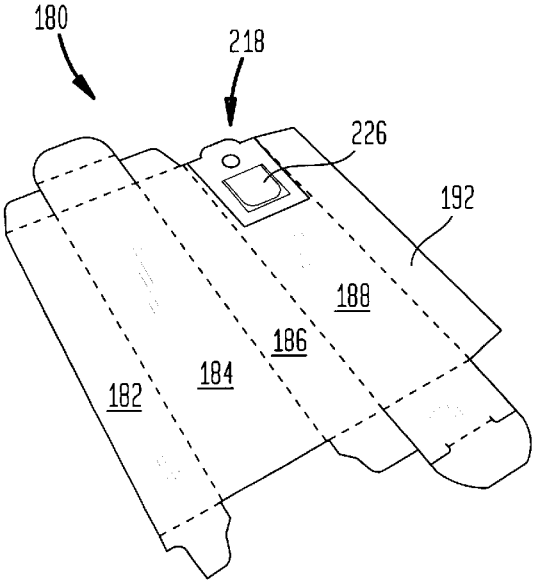
Figure 9D:
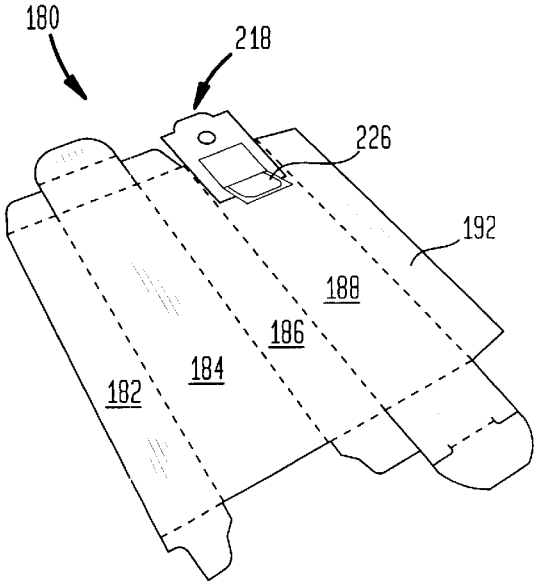

FIG. 8 shows a blank 180 that can be used to construct the carton 160 shown in FIGS. 7A and 7B. The blank 180 is shown from its unfinished interior side, and includes the following elements: a right side panel 182, a front panel 184, and left side panel 186, a rear panel 188 with an integrally formed tongue member 190, and a glue flap panel 192. The top of the blank 180 includes a top panel 194 with a tuck 196 and a pair of dust flaps 198 and 200 for closing the top of the finished carton. The bottom of the blank 180 includes a bottom panel 202 with a tuck 204 and a pair of slit locks 206 and 208, and a pair of dust flaps 210 and 212 with projections 214 and 216 that interlock with the slit locks 206 and 208 to close the bottom of the finished carton.

Extending from the top of the rear panel is a hang tab 218, which is upside-down in the blank 180, as during fabrication of the carton, it will be folded down towards the rear panel 188 along a pair of breakaway nicked sections 220 and 222 that, until they are broken, function as score lines. The hang tab 218 includes an eye 214 dimensioned to fit over a post in a hang display. The hang tab 218 further includes a central square 226 that is cut through on three sides and is held in place by a series of nicks 228 at its bottom. The central square 226 is positioned such that when the hang tab 218 is folded down over the rear panel 188 along nicked sections 220 and 222, the central square 226 is positioned directly over the tongue member 190 in the rear panel 188. A cut 230 is provided between nicked sections 220 and 222. The cut 230 is shaped such that when the hang tab 218 is folded down over the rear panel 188, the uppermost portion of the hang tab 218 projects upward, allowing ready access to the hang tab by the user of the carton.

FIGS. 9A through 9D show a series of sequential perspective views illustrating the construction and operation of the hang tab 218 shown in FIG. 5. As shown in FIGS. 6B and 6C, the hang tab is folded along score lines 220 and 222 until it abuts the rear panel 188. In addition, the central square 226 lies directly over and abuts the tongue member 190 in the rear panel 188.

The central square 226 is glued onto the tongue member 190, such that when the tongue member 190 is pushed into the interior of the carton, the central square 226 breaks off and becomes part of the tongue member 190. This construction serves to reinforce the tongue member 190 and also ensures a close fit of the tongue member 190 into the central slot remaining in the hang tab after the central square 226 has been broken away. As illustrated in FIG. 6D, after the tongue member 190 has been pushed into the interior of the carton and the central square 226 has been broken away, the hang tab 218 can then be pulled upward by breaking the nicked sections 220 and 222 at either side of the hang tab 218. As described above, the tongue member 190 and the attached central square 226 prevent the hang tab from being pulled completely out of the carton by engaging the cross bar at the bottom of the hang tab's central slot.

When the box is fully constructed, the front panel 184, right and left side panels 182 and 186, rear panel 188 and glue flap panel 192 are folded into a rectangular tube, and the glue flap panel 192 is glued to the interior surface of the right side panel 182. It will be seen that the lateral movement of the hang tab 218 after it has been broken away from the rear panel 188 is limited by the left side panel 186 and the right side panel 182 with its attached glue flap panel 192.

Figure 10:
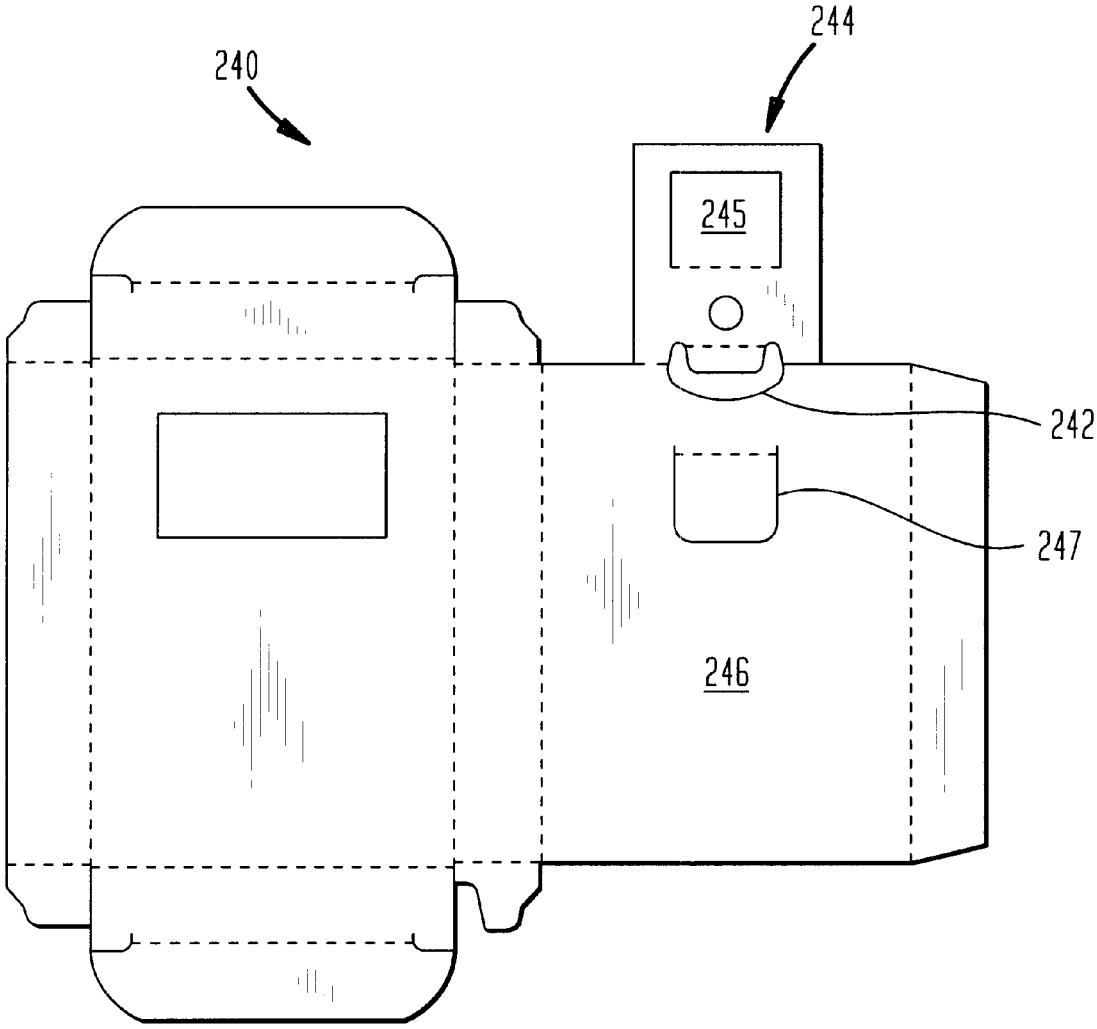
FIG. 10 shows an interior plan view of a carton blank according to a fifth embodiment of the present invention.

FIG. 10 shows a plan view of the interior side of a carton blank 240 according to a further embodiment of the present invention. Although the overall shape of the carton is somewhat flatter and wider, this carton blank 240 is similar in structure and function to the carton blank shown in FIGS. 7A–C, 8, and 9A–D. Of particular interest in the FIG. 10 carton blank 240 is the cutout section 242 between the hang tab 244 and the rear carton panel 246. The cutout 242 is crescent-shaped and serves to facilitate the folding of the hang tab 244 down over the rear carton panel 246 and to facilitate access to the hang tab 244 in the finished carton. In particular, the cutout 242 prevents the unattached portion of the hang tab 244 immediately adjacent to the rear carton panel 246 from getting caught by the rear carton panel 246 during the folding operation. It is this unattached portion of the hang tab 244 that protrudes upward in the finished carton to provide ready access by the user. Again, after the hang tab 244 is folded down over the rear carton panel 246, a breakaway central square section 245 of the hang tab 244 is glued to a tongue member 247 formed in the rear carton panel 246.

Figure 11:
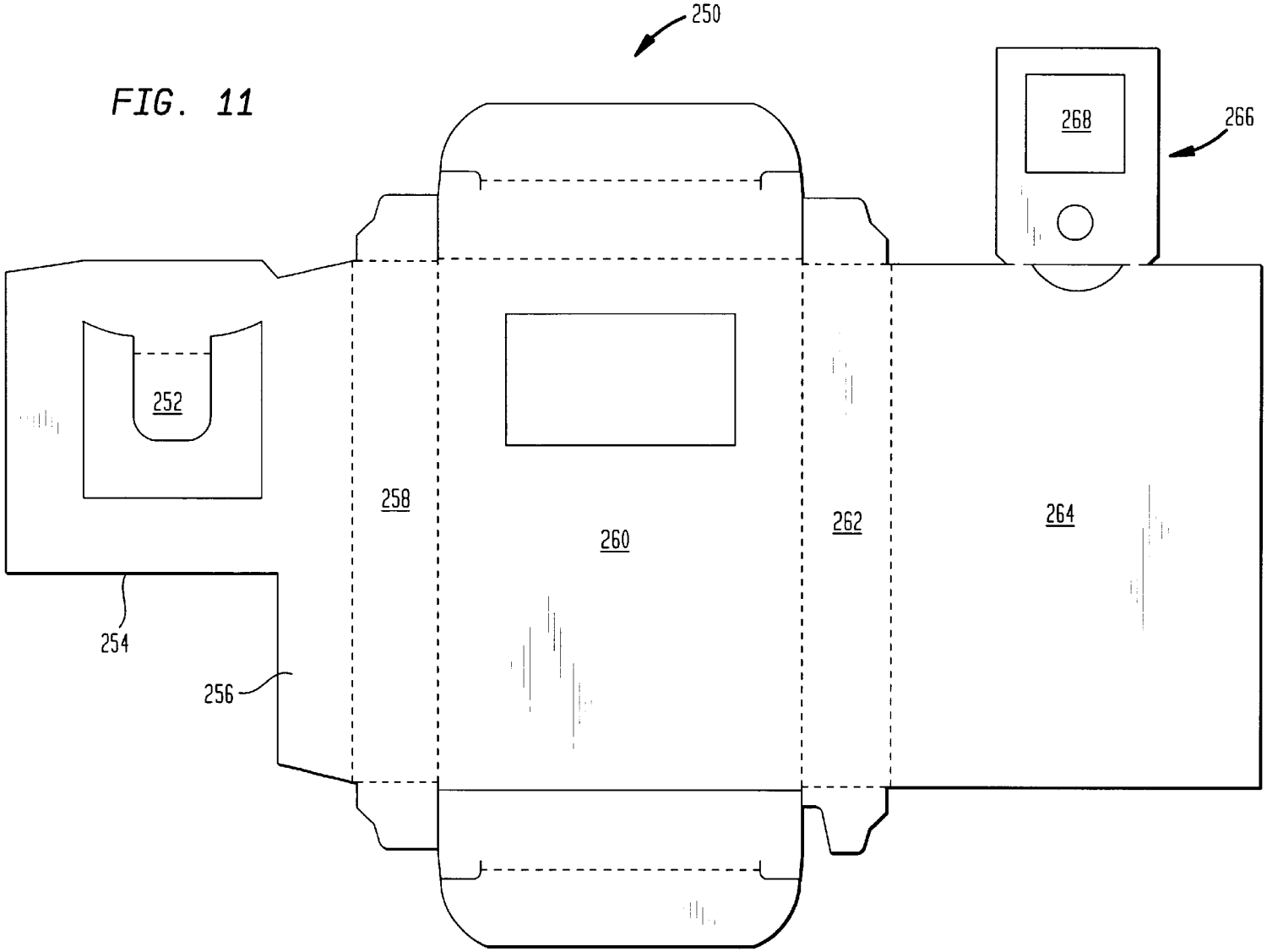
FIG. 11 shows an interior plan view of a carton blank according to a sixth embodiment of the present invention.

FIG. 11 shows a plan view of the interior side of a carton blank 250 according to a further embodiment of the present invention. Here, instead of being cut into the rear carton panel, the tongue member 252 is disposed inside of a supporting frame 254 that extends from a glue flap panel 256, which in turn extends from the carton's right side panel 258. The blank 250 further includes a front panel 260, a left side panel 262, and a rear panel 264. A hang tab 266 having a breakaway central square portion 268 extends upward from the rear panel 264. During construction of a carton from the blank 250, the hang tab 266 is folded down over the rear carton panel 264. After the tongue member 252, supporting frame 254 and glue flap panel 256 have been folded into position, the hang tab's central breakaway square portion 268 is glued to the tongue member 252, and the glue flap panel 256 is glued to a corresponding portion of the rear carton panel 264. In the finished carton, when the hang tab 264 is pulled upward, it causes the central square member 268 to break away, remaining attached to the tongue member 252 which engages the central slot remaining in the hang tab 266 after the central square member 268 has been broken away.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

We claim:

1. A carton, comprising:

a hang tab slidable between a first, retracted position in which the hang tab is tucked behind a first carton panel, and a second, extended position in which the hang tab extends out from behind the first carton panel for hanging the carton on a display, the carton including a hang tab restraint for preventing the hang tab from extending beyond its second position, the hang tab being initially held in its first position by a breakaway attachment that attaches the hang tab to the carton.

2. The carton of claim 1, further including second and third panels that are angled and positioned with respect to the first panel such that the second and third panels limit the lateral motion of the hang tab.

3. The carton of claim 2, wherein the second and third panels are perpendicular to the first panel.

4. The carton of claim 1, wherein the hang tab has a pair of shoulders and a narrower head section, and wherein the hang tab restraint comprises:

a yoke flap extending from one end of the first carton panel, the yoke flap folded over the hang tab and having an opening dimensioned such that the head section of the hang tab passes through the opening and such that the hang tab is prevented from passing entirely through the opening by the hang tab shoulders engaging the yoke flap on either side of the opening.

5. The carton of claim 4, wherein the yoke flap includes a glue tab extending from one end, the glue tab being attached to the first carton panel below the hang tab such that the hang tab is trapped beneath the yoke flap.

6. The carton of claim 4, wherein the yoke flap includes glue sections on either side of the yoke opening, the glue sections being attached to the first carton panel on either side of the hang tab such that the hang tab is trapped beneath the yoke flap.

7. The carton of claim 4, wherein the hang tab is initially held in its first position by a first set of breakaway nicks that attach the hang tab to a hang tab support arm extending upward from a hang tab support panel abutting the first carton panel.

8. The carton of claim 7, wherein the hang tab is additionally initially held in the first position by a second set of breakaway nicks that attach the hang tab to a glue flap panel abutting a second carton panel.

9. The carton of claim 8, wherein the hang tab support arm, the hang tab support panel, the glue flap and the hang tab together define an opening through which a yoke glue flap extending from the yoke flap can be glued to the first carton panel.

10. The carton of claim 4, wherein the hang tab is initially held in its first position by a set of breakaway nicks that attach the hang tab to a hang tab support panel abutting the first carton panel.

11. The carton of claim 1, wherein the hang tab includes a central slot, and wherein the hang tab restraint comprises:

a tongue member extending from the first carton panel into the interior of the carton, the tongue member dimensioned to fit closely within the hang tab central slot, the tongue member engaging the central slot to prevent the hang tab from being extended beyond its second position.

12. The carton of claim 11, wherein the tongue member is cut into the first carton panel.

13. The carton of claim 12, wherein the hang tab includes a square member filling the central slot, the square member being attached to the hang tab by breakaway nicks, and wherein the square member is attached to the tongue member, such that when the hang tab is pulled away from the square member, the square member remains attached to the tongue.

14. The carton of claim 12, wherein the hang tab is attached to an upper edge of the first carton panel by breakaway nicks.

15. The carton of claim 14, further including a cutout portion between the hang tab and the first carton panel between the breakaway nicks to facilitate the folding of the hang tab over the first carton panel, and to facilitate access to the hang tab after it has been folded.

16. The carton of claim 12, wherein the tongue member is disposed within a supporting frame extending from a glue flap panel abutting a second carton panel.

17. A carton blank, comprising:

a first carton panel;

a yoke flap extending upward from an upper edge of the first carton panel, the first carton panel and the yoke flap defining between them a yoke opening;

a glue flap panel extending from a side edge of the first carton panel;

a hang tab support panel extending from a side edge of the glue flap, opposite the first carton panel;

a hang tab support and extending upward from the hang tab support panel; and a hang tab attached by breakaway nicks to the glue flap panel and the hang tab support arm, the hang tab being positioned with respect to the yoke opening and glue flap panel such that when the glue flap panel is folded into position for gluing, the hang tab is aligned underneath the yoke opening, with an upper portion of the hang tab protruding through the yoke opening when the yoke flap is folded down over the hang tab.

18. The carton of claim 17 further including a yoke glue tab extends upward from the yoke flap, and wherein the hang tab, hang tab support arm, hang tab support panel and glue flap together define a yoke glue tab opening, such that when the glue flap is folded into position for gluing and the yoke flap is folded down over the hang tab, the yoke flap glue tab can be glued to the first panel carton through the yoke glue tab opening, thereby trapping the hang tab underneath the yoke flap.

19. A carton blank, comprising:

a first carton panel;

a yoke flap extending upward from an upper edge of the first carton panel, the first carton panel and the yoke flap defining between them a yoke opening;

a glue flap panel extending from a side edge of the first carton panel;

a hang tab support panel extending from a side edge of the glue flap, opposite the first carton panel; and a hang tab attached by breakaway nicks to the hang tab support panel, the hang tab being positioned with respect to the yoke opening and glue flap panel such that when the glue flap panel is folded into position for gluing, the hang tab is aligned underneath the yoke opening, with an upper portion of the hang tab protruding through the yoke opening when the yoke flap is folded down over the hang tab.

20. The carton blank of claim 19, wherein the yoke flap includes a pair of glue sections on either side of the yoke opening, the glue sections behind positioned such that when the yoke flap is folded down over the hang tab and the glue sections are attached to the first carton panel, the hang tab is trapped beneath the yoke flap.

21. A carton blank, comprising:

a first carton panel;

a yoke flap extending upward from an upper edge of the first carton panel, the first carton panel and the yoke flap defining between them a yoke opening;

a hang tab extending upward from the yoke flap, attached to the yoke flap by breakaway nicks;

the hang tab being positioned with respect to the yoke opening and glue flap such that when the hang tab is folded down over the yoke flap and the hang tab and yoke flap are folded down over the first carton panel, the hang tab is aligned underneath the yoke opening, with an upper portion of the hang tab protruding through the yoke opening.

22. The carton blank of claim 21, wherein the yoke flap includes a glue tab that, after the hang tab and yoke flap are folded down over the first carton panel, is attached to the rear carton panel beneath the yoke flap, trapping the hang tab between the yoke flap and the rear carton panel.

23. A carton blank, comprising:

a first carton panel;

an inverted hang tab extending upward from the first carton panel, the hang tab including a central slot;

a tongue member extending from the first carton panel, the tongue member positioned relative to the hang tab such that when the hang tab is folded downward over the tongue member, the tongue member is aligned with the hang tab central slot so that the tongue member engages the hang tab central slot to limit the vertical movement of the hang tab.

24. The carton blank of claim 23, wherein the tongue member is cut into the first carton panel.

25. The carton blank of claim 23, wherein the hang tab central slot is initially filled by a central breakaway member that, after the hang tab is folded down over the first carton panel, is attached to an edge of the central slot by breakaway nicks, and wherein the central breakaway member is glued to the tongue member, such that when the tongue member is pushed inward, the central breakaway member breaks away from the hang tab and becomes part of the tongue member.

26. The carton blank of claim 25, further including a cutout section between the breakaway nicks, the cutout section facilitating the folding of the hang tab down over the first carton panel and facilitating access to the hang tab.

27. A carton blank, comprising:

a first carton panel;

an inverted hang tab extending upward from the first carton panel, the hang tab including a central slot;

a tongue member extending from a supporting frame extending from a second carton panel, the tongue member positioned relative to the hang tab such that when the hang tab and supporting frame are folded into position, the tongue member is aligned with the hang tab central slot so that the tongue member engages the hang tab central slot to limit the vertical movement of the hang tab.

28. A method for manufacturing a carton, comprising the following steps:

(a) attaching a hang tab to a carton blank by breakaway nicks, the hang tab having a pair of shoulders and a narrower head section;

(b) positioning the hang tab underneath a yoke flap extending from a first carton panel, the yoke flap having an opening therein dimensioned to allow the hang tab head section to pass therethrough, the yoke flap opening having side sections that prevent the hang tab from passing all the way through the opening by engaging the hang tab shoulders; and (c) folding the yoke flap over the hang tab, such that an upper portion of the hang tab protrudes from the opening.

29. The method of claim 28, further including:

(d) attaching the yoke flap to the first carton panel such that the hang tab is trapped between the yoke flap and the first carton panel.

30. A method for manufacturing a carton, comprising the following steps:

(a) attaching a hang tab to a carton blank by breakaway nicks, the hang tab having a central slot; and (b) folding the hang tab over a first carton panel such that the hang tab central slot is aligned over a tongue member that engages the central slot to prevent the hang tab from being pulled all the way out of the carton.

31. The method of claim 30, further including cutting the tongue member into the first carton panel.

32. The method of claim 30, further including placing the tongue member into a supporting frame extending from a second carton panel.

* * * * *